US006962190B2

(12) United States Patent
Heggset

(10) Patent No.: US 6,962,190 B2
(45) Date of Patent: Nov. 8, 2005

(54) CASTING WHEEL FOR CONTINUOUS CASTING OF METAL

(75) Inventor: Bjarne A. Heggset, Kristiansund (NO)

(73) Assignee: Heggset Engineering A.S., Kristiansund (NO)

( * ) Notice: Subject to any disclaimer, the term of this patent is extended or adjusted under 35 U.S.C. 154(b) by 0 days.

(21) Appl. No.: 10/501,822

(22) PCT Filed: Jan. 22, 2003

(86) PCT No.: PCT/NO03/00020

§ 371 (c)(1),
(2), (4) Date: Jul. 19, 2004

(87) PCT Pub. No.: WO03/064078

PCT Pub. Date: Aug. 7, 2003

(65) Prior Publication Data

US 2005/0045302 A1 Mar. 3, 2005

(30) Foreign Application Priority Data

Jan. 30, 2002 (NO) ..... 020492

(51) Int. Cl.[7] ..... B22D 11/06
(52) U.S. Cl. ..... 164/433; 164/436

(58) Field of Search ..... 164/433, 482, 164/436, 271

(56) References Cited

U.S. PATENT DOCUMENTS

| | | | | |
|---|---|---|---|---|
| 3,206,809 A | * | 9/1965 | Herrmann | 164/485 |
| 3,626,479 A | | 12/1971 | Properzi | |
| 3,735,801 A | | 5/1973 | Burkhardt | |
| 4,122,889 A | | 10/1978 | Richards | |
| 4,235,278 A | * | 11/1980 | Delatte et al. | 164/433 |
| 4,300,618 A | | 11/1981 | Properzi | |

* cited by examiner

*Primary Examiner*—Len Tran
(74) *Attorney, Agent, or Firm*—Osha Liang LLP

(57) ABSTRACT

Casting wheel for continuous casting of metal, including a casting groove for the metal along its periphery, for supply of metal melt while the wheel rotates in a vertical plane, said wheel cooperating with an endless belt that runs together with the wheel during a part of the rotation of the wheel and covers the groove while forming a casting chamber. The wheel comprises two wheel rings mounted for rotation about axes that are set at an angle between each other, whereby the width of the groove varies during rotation of the wheel. The wheel rings defines a first groove wall and the groove bottom, while the other wheel ring defines the other groove wall, which moves axially relatively to the first groove wall, along the groove bottom.

4 Claims, 2 Drawing Sheets

CASTING WHEEL FOR CONTINUOUS CASTING OF METAL

FIELD OF THE INVENTION

The present invention relates to a casting wheel for continuous casting of metal, including a casting groove for the metal along its periphery, for supply of metal melt while the wheel rotates in a vertical plane, said wheel cooperating with an endless belt that runs together with the wheel during a part of the rotation of the wheel and covers the groove while forming a casting chamber.

PRIOR ART

Installations for such casting are known, and appear inter alia from the U.S. Pat. Nos. 3,583,474 and 4,300,618.

U.S. Pat. No. 3,583,474 shows a casting machine with a vertical rotatable casting wheel with a groove along its periphery forming a casting chamber, which is closed by an endless belt, which may be of steel, approximately around half the periphery of the wheel. The belt moves with the rotation of the wheel as the belt runs around one or more cylinders at a distance from the wheel. Melted metal is supplied to the casting chamber approximately at the point where the belt comes into contact with the wheel, and a partially solidified string of metal is led away from the wheel about 200° from the point where the melt is supplied. The belt has left the wheel at the point where the string is led out of the wheel, so that the groove in the wheel opens outwardly. The document shows means for cooling the wheel, both on the inside of the wheel ring and the outside of the belt in the sector where this moves with the wheel. The wheel ring has a constant cross section, and the casting chamber between the groove and the belt sector that moves with the wheel determines the cross section of the string being cast. Here, string also means a string with a relatively large cross section, such as an ingot. The string may be used in any manner. The string may for instance be rolled to a belt immediately after the casting. When casting a string of aluminium, the melt that is supplied has a temperature of 600° C., and during the 200° rotation at which the string moves with the wheel, it is cooled to approximately 450–400° C. Then the string is doughy, but continuous, and is relatively easily deformed.

U.S. Pat. No. 4,300,618 shows inter alia a casting wheel for casting a strip, in which a wall in the casting groove may be set to different distances from the other wall, for producing strips of different widths without the need of changing the casting wheel. Spacer rings with different widths are used, which are inserted between the adjustable wall and a releasable wheel flange.

A problem that arises with such casting is insufficient control over the string temperature during and after the solidification. This influences both the metal structure, the tensile strength and the rollability. The main reason for the problem is assumed to be that the metal that is cast shrinks during the cooling and solidification. Hence, contact between the string and the casting groove ceases completely or partially, so that the heat transfer between the string and the wheel is changed, because poor heat conducting air is introduced into the gap that is formed.

SUMMARY OF THE INVENTION

The present invention provides a casting wheel that solves this problem.

The casting wheel according to the invention is characterized by comprising two wheel rings that are mounted for rotation about axes set with an angle between them, so that the width of the groove varies during the rotation of the wheel.

According to the invention the width of the casting groove varies constantly in the direction of the periphery when the wheel is rotating, wherein the width is largest in the area where the melt is supplied and smallest in the area where the string leaves the wheel. From the latter to the former area the width of the groove is increasing, so that removal of the string is facilitated.

The angle between the wheel rings may be fixed, but in order to be able to adjust the casting wheel to different metals and also to adjust the angle to the width of the groove and hence the shrinking of the metal, the angle that the axes of the wheel rings are forming together may be adjustable. In any case, contact with the walls in the groove may be obtained to a greater degree for the string being cast than in the prior art casting wheels.

Adjusting of the angle between the axes of the wheel rings may be obtained in several known ways, e.g. by the shafts of the wheel rings being mounted in bearing housings that may be angularly adjusted relatively to each other.

The angle between the axes of the wheel rings may e.g. for a wheel with an outer diameter of approximately 2 m, be such that the variation of width is approximately 2–3 mm.

Supply of melt to the casting groove may take place anywhere in a sector from the top of the wheel to about 90° from the top in the direction of rotation.

Obviously, it is essential that the variation of width takes place in a way that is adapted to the point for supplying the melt and the outlet of the string from the wheel. This is obtained by choice of the rotational position of the planes in which the wheel rings are rotating. If the melt is supplied at the top of the wheel, the planes may for instance be so that the width of the groove is largest at the top and smallest at the bottom; i.e. an imaginary extension of the planes of the wheel rings makes an angle about a horizontal axis located below the wheel rings. If the melt is supplied 90° from the top of the wheel, then the extension of the planes makes an angle about a vertical axis, and if the melt is supplied between the top of the wheel and the point of 90°, the axis will be inclined.

The wheel rings may be shaped so that one of the wheel rings defines a groove wall and the groove bottom while the other wheel ring defines the other groove wall. In that case, the latter wheel ring has a radially inner limitation of the groove wall resting on the groove bottom formed by the former wheel ring. Due to the angle between the wheel rings there is a small gap, that will not lead to any substantial leakage of melt. In order to prevent leakage, the wheel rings may be mounted slightly eccentrically relatively to each other, in such a way that the wheel rings are in mutual engagement in the area where the melt is supplied, while a small gap occurs during rotation away from this area. Hence, the gap is closed while the melt is supplied and opens towards the area where the melt is solidified.

The belt closing the casting groove may be tight and secure sealed closing, but in order to ensure that the casting string does not drive the belt away from the wheel due to the pressure in the casting string, support rolls may be located along the outside of the belt where this moves along the wheel.

The invention will be further explained in the following by means of an example of embodiment of the casting wheel, illustrated in the appended drawings.

DESCRIPTION OF AN EMBODIMENT

Figures 1, 2, 3:
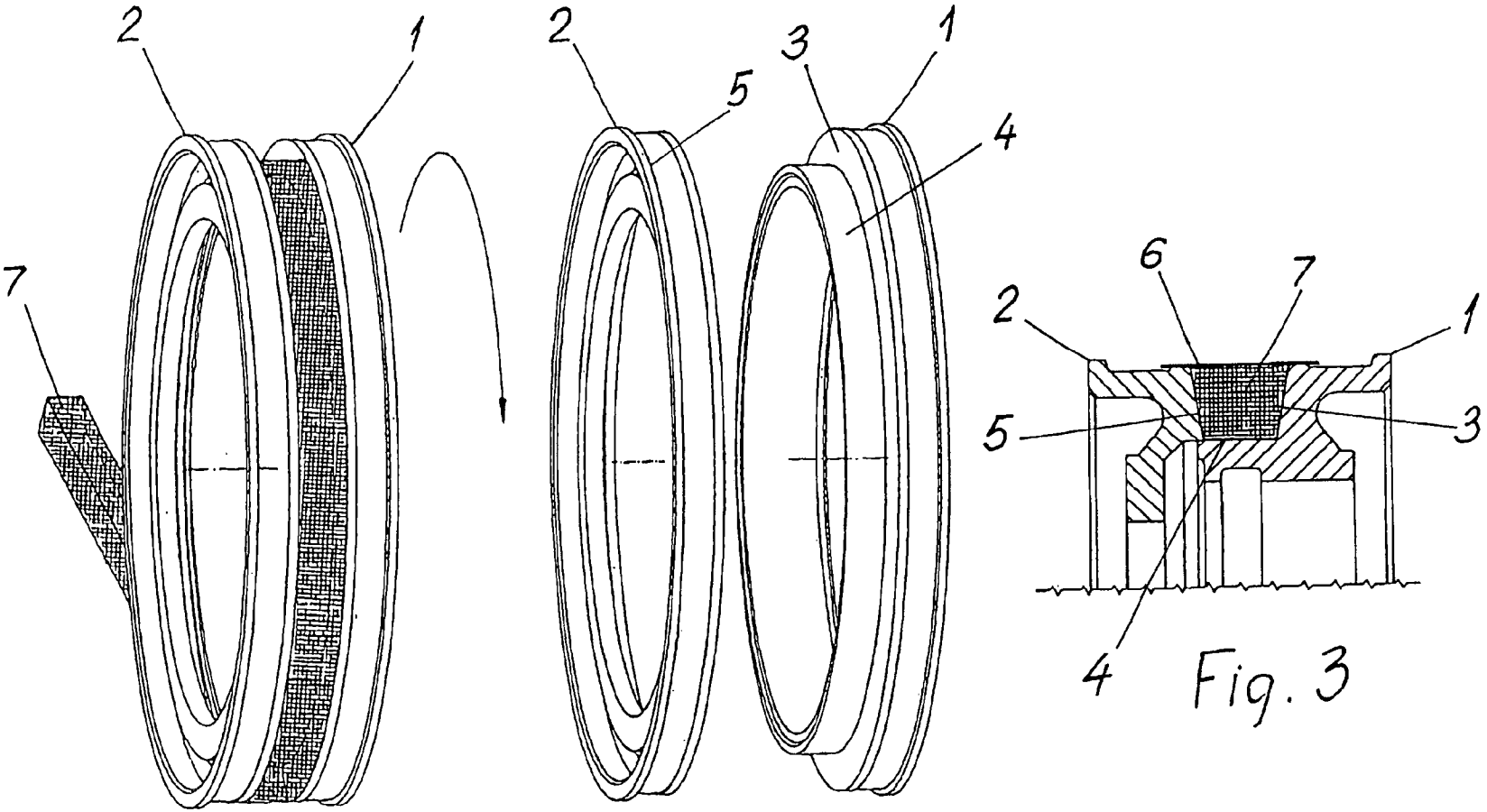
FIG. 1 shows in perspective a casting wheel according to the invention, during casting of a metal string.
FIG. 2 shows in perspective the two wheel rings comprising the casting wheel.
FIG. 3 shows an axial view through the combined wheel rings of the casting wheel.

FIG. 1 shows a casting wheel according to the invention, comprising two wheel rings 1 and 2 with rotational axes that form an angle with each other. It is understood that during use the wheel rings are connected to a respective shaft, not shown, via e.g. spokes or disks. The shafts are mounted so that their axes form an angle with each other, so that the wheel rings will rotate in planes forming a certain angle with each other. A belt, e.g. of steel, and not shown, moves with the wheel and covers the casting groove for about 200°, and the metal melt is supplied to the wheel in the upper section and moves with the wheel in a rotational angle exceeding the angle in which the belt moves along with the wheel, whereupon the cooled and partially solidified melt exits as a string 7. The rotational direction is shown by an arrow in FIG. 1.

FIG. 2 shows the wheel rings separated, and it appears that the wheel ring 1 has a circumferential surface forming one of the walls in a casting groove and a second circumferential surface forming the bottom of the casting groove. The wheel ring 2 has a circumferential surface 5 forming the other wall in the casting groove when the wheel rings 1 and 2 are mounted together.

FIG. 3 shows an axial section through the wheel rings 1 and 2 in the mounted condition. In the section it is also shown a belt 6, e.g. of steel, and which together with the walls 3 and 5 and the bottom 4 defines a casting chamber, in which a metal string 7 may be cast during the rotation of the casting wheel in a certain angle, in which the belt 6 runs together with the casting wheel and forms a closure for the casting groove. The wall 5 formed by the wheel ring 2 has a radially inner limitation with a radius that corresponds rotational axes are forming a small angle with each other, during rotation of the wheel rings 1 and 2, the wall 5 will move axially relatively to the wall 3 in the wheel ring 1, along the groove bottom 4, so that the width of the casting groove varies during rotation. By securing that the width is largest in the area where the melt is supplied to the casting groove, due to the angle between the planes in which the wheel rings rotate, the width of the groove will decrease during the following half revolution of the wheel rings, and it can be secured that the reduction of width approximately corresponds to the lateral shrinking of the cast string during cooling, so that the engagement of the cast string against the walls 3 and 5 in the casting groove substantially is maintained, whereby the cooling is improved relatively to the case when there is formed a gap of air between the cast string and at least one of the groove walls 3 and 5.

Figure 4:
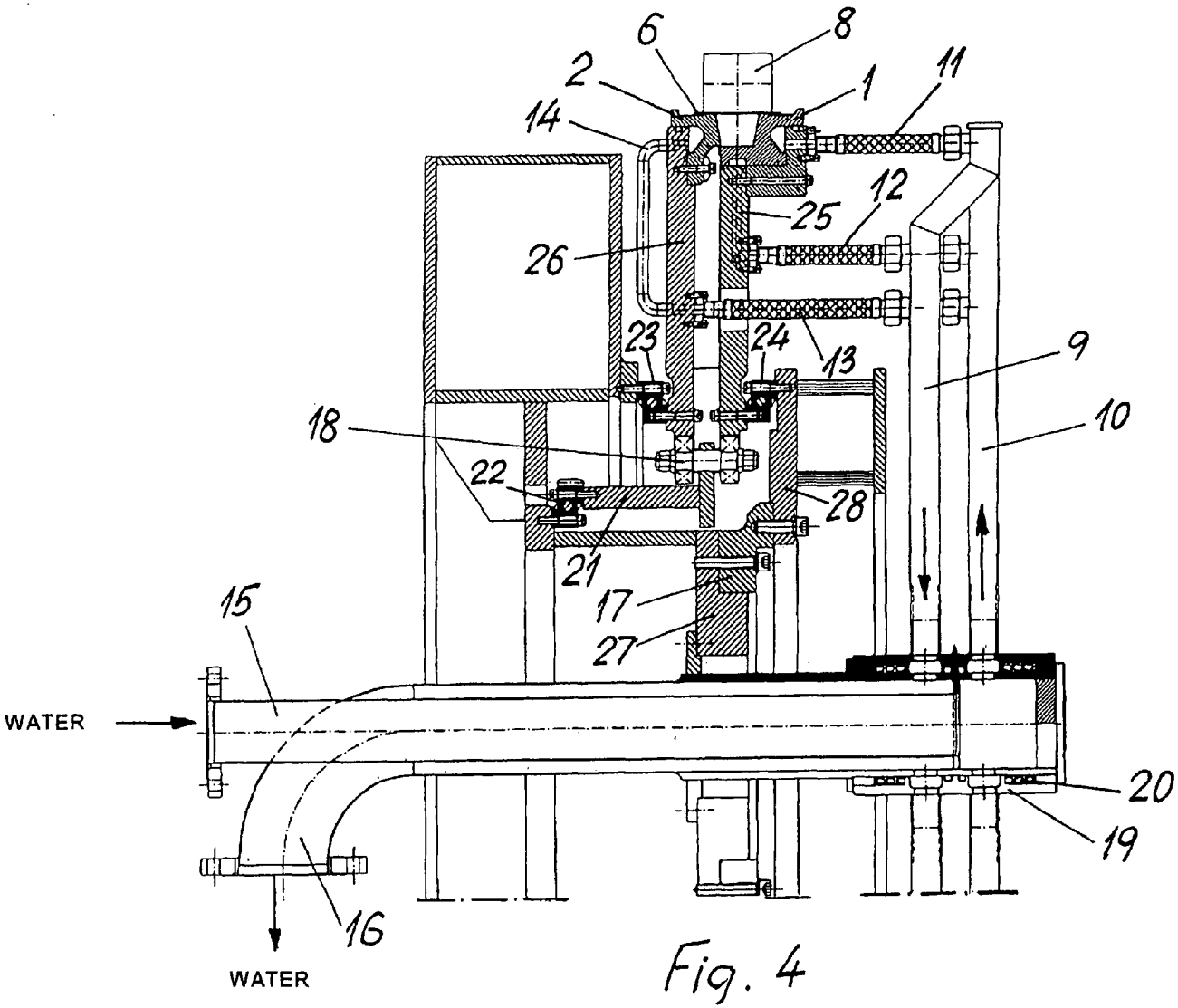
FIG. 4 shows more detailed how the casting machine may be constructed.

FIG. 4 shows a segment of a casting machine comprising a casting wheel according to the invention, in which the casting wheel comprises two wheel rings 1 and 2. The figure shows supply and outlet of cooling water through axial pipes 15 and 16, a plurality of radial, rotating pipes 9 and 10, hoses 11, 12 and 13 and an interconnecting pipe 14 between an annulus along the wheel ring 2 and the hose 13. A swivel connection 19 leads the water from and to the pipes 15 and 16, and includes gaskets 20 for sealing.

The stationary components of the machine, including a not shown driving motor, is mounted on a floor via not shown parts. The driving shaft of the motor is in engagement with a driving rim 22, which is combined with a bearing for a driving ring 21. A carrier 18 drives discs 25 and 26 in rotation, by rings on the carrier engaging recesses radially innermost on the discs 25 and 26. The discs 25 and 26 constitute parts of the wheel rings 1 and 2, and are mounted via bearings 24 and 23.

Between stationary rings 27 and 28, there is mounted an intermediate flange 17 determining the angle between the rotational axes of the wheel rings 1 and 2. The intermediate flange has a varying width, so that said angle between the axes of the wheel rings 1 and 2 is formed, and it is exchangeable so that the angle may be changed by mounting of another intermediate flange that alters the position of the disc 25 carrying the wheel ring 1. The intermediate flange 17 also determines the eccentricity of the wheel rings 1 and 2 relatively to each other. The intermediate flange may be mounted in optional positions in the circumferential direction, so-that it may be chosen where in the circumferential direction the width of the casting groove between the wheel rings 1 and 2 is to be largest and smallest.

The figure shows a belt 6 running towards the outside of the wheel rings 1 and 2. The belt 6 is supported at the outside by support rollers 8, of which only one is shown. The support rollers 8 are located along the sector of a circle where the belt 6 delimits the casting groove in which the melt is supplied.

What is claimed is:

1. A casting wheel for continuous casting of metal, including a casting groove for the metal along its periphery, for supply of metal melt while the wheel rotates in a vertical plane, said wheel cooperating with an endless belt that runs together with the wheel during a part of the rotation of the wheel and covers the groove while forming a casting chamber, characterized in that the wheel comprises two wheel rings mounted for rotation about axes that are set at an angle between each other, whereby the width of the groove varies during rotation of the wheel.

2. The casting wheel according to claim 1, comprising means for regulating the angle between the axes.

3. The casting wheel according to claim 1, in which one of the wheel rings defines a first groove well and the groove bottom, while the other wheel ring defines the other groove wall.

4. The casting wheel according to claim 2, in which one of the wheel rings defines a first groove well and the groove bottom, while the other wheel ring defines the other groove wall.

* * * * *